US007904004B2

(12) United States Patent
Tanaka

(10) Patent No.: US 7,904,004 B2
(45) Date of Patent: Mar. 8, 2011

(54) POWDER SUPPLYING DEVICE, METHOD OF FILLING POWDER INTO POWDER SUPPLY DEVICE, AND METHOD OF REUSING POWDER SUPPLYING DEVICE

(75) Inventor: Hideaki Tanaka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 682 days.

(21) Appl. No.: 11/640,258

(22) Filed: Dec. 18, 2006

(65) Prior Publication Data

US 2007/0280741 A1 Dec. 6, 2007

(30) Foreign Application Priority Data

Jun. 2, 2006 (JP) ..... 2006-154410

(51) Int. Cl.
*G03G 15/08* (2006.01)

(52) U.S. Cl. ..... 399/258

(58) Field of Classification Search ..... 399/258, 399/262, 263

See application file for complete search history.

(56) References Cited

U.S. PATENT DOCUMENTS

| | | | |
|---|---|---|---|
| 6,421,517 | B1 | 7/2002 | Nishino et al. |
| 7,529,509 | B2 * | 5/2009 | Ito et al. ..... 399/258 |
| 2001/0021314 | A1 | 9/2001 | Hibi |
| 2002/0021919 | A1 | 2/2002 | Tamaki et al. |
| 2005/0025544 | A1 | 2/2005 | Yamashita et al. |

FOREIGN PATENT DOCUMENTS

| | | | |
|---|---|---|---|
| JP | 2000-330365 | A | 11/2000 |
| JP | 2001-305847 | A | 11/2001 |
| JP | 2001-350335 | A | 12/2001 |
| JP | 2002-244422 | A | 8/2002 |
| JP | 2003-5500 | A | 1/2003 |
| JP | 2003-255681 | A | 9/2003 |
| JP | 2004-37557 | A | 2/2004 |
| JP | 2004-198800 | A | 7/2004 |
| JP | 2004-264674 | A | 9/2004 |
| JP | 2005-49543 | A | 2/2005 |
| JP | 2005-49673 | A | 2/2005 |

OTHER PUBLICATIONS

Australian Office Action dated Jul. 10, 2009.
Japanese Office Action dated Aug. 25, 2009.

* cited by examiner

*Primary Examiner* — David M Gray
*Assistant Examiner* — Ruth N Labombard
(74) *Attorney, Agent, or Firm* — Sughrue Mion, PLLC

(57) ABSTRACT

The present invention provides a method of filling a powder into a powder supplying device including: a housing that accommodates the powder; a rotating member disposed rotatably within the housing; a sheet-shaped conveying member fixed to the rotating member, whose free end side region, which is different from a fixed portion, slidingly-contacts and moves along an inner wall of the housing by rotation of the rotating member to convey the powder; and a powder supply opening provided at the housing at a downstream side in a direction of conveying the powder, the method including filling, into the housing, the powder in an amount such that, at a time when usage of the powder supplying device starts, a height of the powder is greater than or equal to a height of a bottom surface of the rotating member.

16 Claims, 4 Drawing Sheets

POWDER SUPPLYING DEVICE, METHOD OF FILLING POWDER INTO POWDER SUPPLY DEVICE, AND METHOD OF REUSING POWDER SUPPLYING DEVICE

BACKGROUND

1. Technical Field

The present invention relates to a powder supplying device which, in a container which stores a powder, stirs the powder by rotation of a rotating member such as an agitator or the like, and conveys the powder to a powder supply opening, a method of filling a powder into a powder supplying device, and a method of reusing a powder supplying device.

2. Related Art

Image forming devices, such as copiers, printers and the like, which include: a photosensitive drum; a developing device (powder supplying device) which includes therein an accommodating portion accommodating toner, and which feeds the toner out from a feed opening provided at the front so as to supply the toner to the photosensitive drum; a charging device; a transfer device which transfers toner onto sheets; a cleaning device; and a fixing device which carries out fixing on sheets, are widely used conventionally.

The photosensitive drum, the developing device, the charging device, and the cleaning device are formed integrally, and are provided so as to be able to be replaced as a process cartridge.

The process cartridge is provided with an agitator serving as a stirring/conveying member in which a toner stirring portion and a toner conveying portion, which stir the toner in the accommodating portion and convey the toner to the feed opening, are provided integrally.

As an example of a developing device, there is disclosed a developing device using an agitator formed from an elastic sheet of polyphenylene sulfide.

In the developing device, by using polyphenylene sulfide, which has an excellent creep characteristic, as the material of the elastic sheet, unnecessary deformation of the elastic sheet under harsh conditions such as high temperature and high humidity, or the device being left to stand for a long time period or the like, can be suppressed. Further, the toner can be supplied well to a developing roller regardless of the amount of toner within the developing device.

However, in the developing device, when the agitator is rotated in a state in which the amount of toner filled in the developing device is low (e.g., is lower than the axis of rotation of the agitator), at the region where there is no toner, the free end of the agitator contacts the inner wall of the developing device with a force due to rotational force and elastic recovering force, and noise is generated.

Because there are cases in which the image forming device is used late at night or the like, the quietness of the image forming device, including the developing device, is an important problem.

This problem is not limited to the developing device in patent document 1, and the same holds for devices provided with a stirring/conveying member which, within a container accommodating a powder such as a toner or a developer containing a toner or the like, stirs and/or conveys the powder by a rotating body such as an agitator or the like which is elastic.

SUMMARY

An aspect of the present invention is a method of filling a powder into a powder supplying device including: a housing that accommodates the powder; a rotating member disposed rotatably within the housing; a sheet-shaped conveying member fixed to the rotating member, whose free end side region, which is different from a fixed portion, slidingly-contacts and moves along an inner wall of the housing by rotation of the rotating member to convey the powder; and a powder supply opening provided at the housing at a downstream side in a direction of conveying the powder, the method including filling, into the housing, the powder in an amount such that, at a time when usage of the powder supplying device starts, a height of the powder is greater than or equal to a height of a bottom surface of the rotating member.

BRIEF DESCRIPTION OF THE DRAWINGS

Exemplary embodiments of the present invention will be described in detail with reference to the following figures, wherein.

DETAILED DESCRIPTION

A first exemplary embodiment of a powder supplying device, a method of filling a powder into a powder supplying device, and a method of reusing a powder supplying device of the present invention will be described on the basis of the drawings.

Figure 1:
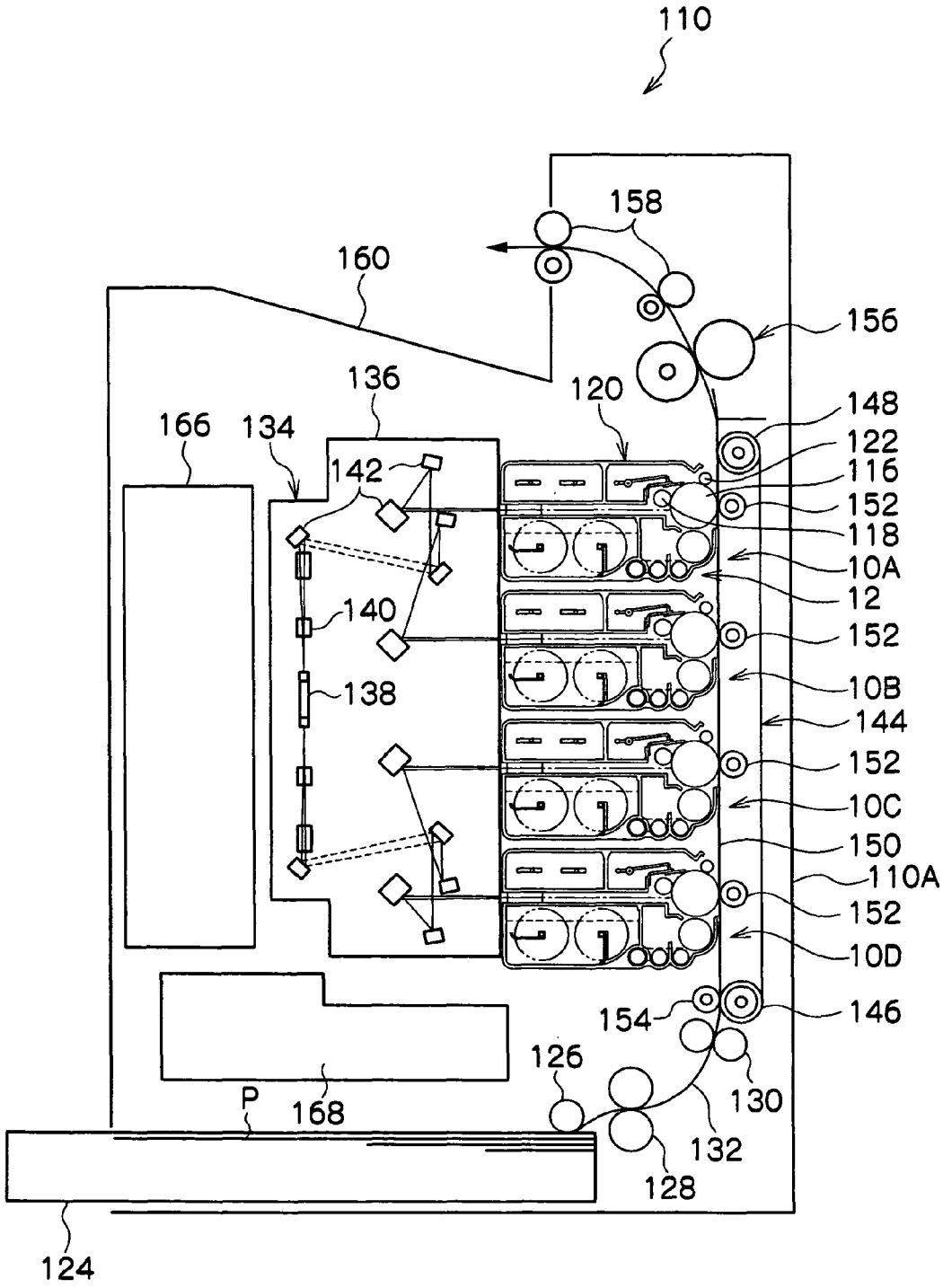
FIG. 1 is a cross-sectional view of a printer provided with developing devices of the present invention.

A printer 110, in which are installed developing devices 10A, 10B, 10C, 10D serving as powder supplying devices of the present invention, is shown in FIG. 1.

Four process cartridges 120, which carry out full-color image formation by toners of four colors (yellow (Y), magenta (M), cyan (C), black (K)), are lined-up in the printer 110 along the vertical direction in correspondence with the respective colors.

The respective Y, M, C, K toners are not particularly limited by the manufacturing methods thereof, and various types of toners can be used.

For example, as the method of manufacturing the toner, there may be used: a kneading/pulverizing method of kneading, pulverizing, and classifying a binder resin, a colorant, a releasing agent, and, as needed, a charge controlling agent or the like; a method of varying the shapes of particles obtained by the kneading/pulverizing method, by mechanical impact force or thermal energy; an emulsion polymerization aggregation method in which a polymerizable monomer of a binder resin is emulsion-polymerized, and the formed dispersion liquid and a dispersion liquid of a colorant, a releasing agent, and, as needed, a charge controlling agent or the like, are mixed-together, aggregated, and fused by heat so as to obtain toner particles; a suspension polymerization method in which a polymerizable monomer for obtaining a binder resin and a solution of a colorant, a releasing agent, and, as needed, a charge controlling agent or the like, are suspended in an aqueous solvent and polymerized; a dissolution suspension method in which a binder resin and a solution of a colorant, a releasing agent, and, as needed, a charge controlling agent or the like, are suspended in an aqueous solvent and particles are formed; or the like.

Further, known methods, such as a manufacturing method which uses a toner obtained by the aforementioned methods as a core and adheres aggregated particles thereto and carries out heat fusion so as to provide a core-shell structure, and the like can be used. However, from the standpoints of controlling the shape and controlling the particle size distribution, the suspension polymerization method, the emulsion polymerization aggregation method, and the dissolution suspension method which manufacture toner particles in an aqueous solvent are preferable, and the emulsion polymerization aggregation method is particularly preferable. The toner base material is formed from a binder resin, a colorant, and a releasing agent, and, if needed, silica and a charge controlling agent may be used.

A toner of an average particle diameter of 2 to 12 μm can be used, and preferably, a toner mother material of 3 to 9 μm can be used. Good developing and transferability, and images of high image quality can be obtained by using toners whose average shape factor (ML2/A) is 114 to 140.

The average shape factor (ML2/A) means the value calculated by the following formula, and in the case of a perfect sphere, ML2/A=100. ML2/A=(maximum length)$2\times\pi\times100$/(surface area×4). As a specific means for determining the average shape factor, a toner image is taken-in from an optical microscope into an image analyzing device (Luzex III, manufactured by Nireco Corporation), the circle equivalent diameter is measured, and the value of ML2/A in the above formula is determined for the individual particles from the maximum length and the surface area.

Examples of the binder resin which is used are homopolymers or copolymers of styrenes such as styrene, chlorostyrene, and the like; monoolefins such as ethylene, propylene, butylene, isoprene, and the like; vinyl esters such as vinyl acetate, vinyl propionate, vinyl benzoate, vinyl butyrate and the like; (α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, and the like; vinyl ethers such as vinyl methyl ether, vinyl ethyl ether, vinyl butyl ether, and the like; vinyl ketones such as vinyl methyl ketone, vinyl hexyl ketone, vinyl isopropenyl ketone, and the like; and the like. Particularly exemplary binder resins are polystyrene, styrene-alkylacrylate copolymer, styrene-alkylmethacrylate copolymer, styrene-acrylonitrile copolymer, styrene-butadiene copolymer, styrene-maleic anhydride copolymer, polyethylene, polypropylene, and the like.

Further examples include polyester, polyurethane, epoxy resin, silicone resin, polyamide, denatured rosin, paraffin wax, and the like.

Exemplary examples of the colorant of the toner are magnetic powders such as magnetite, ferrite, and the like, and carbon black, aniline blue, calyl blue, chrome yellow, ultramarine blue, DuPont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, C.I. pigment blue 15:3, and the like.

Exemplary examples of the releasing agent are low molecular polyethylene, low molecular polypropylene, Fischer-Tropsch wax, montan wax, camauba wax, rice wax, candelilla wax, and the like.

A charge-controlling agent may be added to the toner as needed. Known charge-controlling agents may be used, and azo-based metal complex compounds, metal complex compounds of salicylic acid, and resin-type charge-controlling agents containing a polar group can be used.

When manufacturing the toner by a wet manufacturing method, from the standpoints of controlling the ion strength and reducing waste water contamination, it is preferable to use a material which is difficult to dissolve in water. The toner in the present invention may be either of a magnetic toner which incorporates a magnetic material, or a non-magnetic toner which does not contain a magnetic material.

The toner used in the present invention can be manufactured by mixing together the aforementioned toner particles and the aforementioned external additives by a Henschel mixer or a V blender or the like. Further, when manufacturing the toner particles by a wet method, the external additives may be added during the wet method.

As lubricating particles which are added to the toner used in the present invention, there may be used: solid lubricants such as graphite, molybdenum disulfide, talc, fatty acids, fatty acid metal salts, and the like; low molecular weight polyolefins such as polypropylene, polyethylene, polybutene, and the like; silicones exhibiting a softening point upon heating; aliphatic amides such as oleic amide, erucic amide, recinoleic amide, stearic amide, and the like; vegetable waxes such as carnauba wax, rice wax, candelilla wax, Japan wax, jojoba oil, and the like; animal wax such as beeswax; mineral or petroleum waxes such as montan wax, ozokerite, ceresin, paraffin wax, microcrystalline wax, Fischer-Tropsch wax, and the like; and modified products thereof A single one of these may be used, or plural types may be used in combination. The particle diameter may be made uniform by pulverizing materials of the aforementioned chemical structures such that the average particle diameter is in a range of 0.1 to 10 μm. The amount added to the toner is preferably 0.05 to 2.0% by weight, and more preferably a range of 0.1 to 1.5% by weight.

Inorganic fine particles, organic fine particles, composite fine particles in which inorganic fine particles are adhered to the organic fine particles, and the like may be added to the toner used in the present invention for purposes such as removing accretions and deteriorated materials on the surface of the electrophotographic photosensitive body. However, inorganic fine particles which have an excellent polishing property are particularly preferable.

Various types of inorganic oxides, nitrides, borides, or the like, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, boric nitride, and the like are preferably used as the inorganic fine particles.

The inorganic fine particles may be subjected to processing by: a titanium coupling agent such as tetrabutyl titanate, tetraoctyl titanate, isopropyl triisostearoyl titanate, isopropyl tridecylbenzenesulfonyl titanate, bis(dioctylpyrophosphate) oxyacetate titanate, and the like; a silane coupling agent such as γ-(2-aminoethyl)aminopropyltrimethoxysilane, γ-(2-aminoethyl) aminopropylmethyldimethoxysilane, γ-methacryloxypropyltrimethoxysilane, N-β-(N-vinylbenzylaminoethyl)γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane, and the like; or the like.

A hydrophobizing treatment by silicone oil, or a higher fatty acid metal salt such as aluminum stearate, zinc stearate, calcium stearate, or the like also is preferably used.

Examples of organic fine particles are styrene resin particles, styrene-acrylic resin particles, polyester resin particles, urethane resin particles, and the like.

If the particle diameter is too small, the polishing ability is lacking. If the particle diameter is too large, it is easy for the surface of the electrophotographic photosensitive body to be scratched. Therefore, particles whose average particle diameter is 5 nm to 1000 nm, and preferably 5 nm to 800 nm, and more preferably 5 nm to 700 nm are used. Further, it is preferable that the sum of the added amount of these particles and the added amount of the lubricating particles is greater than or equal to 0.6% by weight.

With regard to other inorganic oxides that are added to the toner, for powder fluidity, charge control and the like, it is preferable to use small-diameter inorganic oxides whose primary particle diameter is less than or equal to 40 nm, and, for reduction in adhesive force and charge control, it is preferable to add inorganic oxides of a diameter larger than that.

Known inorganic oxide fine particles may be used therefor, but, in order to carry out precise charge control, it is preferable to use silica and titanium oxide in combination. Further, by subjecting small-diameter inorganic fine particles to a surface treatment, the dispersability improves, and the effect of improving the powder fluidity becomes greater.

The color toner for electrophotography is used by being mixed together with a carrier. Iron powder, glass beads, ferrite powder, nickel powder, and materials in which the surfaces of these or other substances are coated with resin, are used as the carrier. The proportion of mixing with the carrier can be set appropriately.

Here, the process cartridge 120 is structured by a photosensitive drum 116, a charging roller 118 and an erase lamp 122 disposed at the periphery of the photosensitive drum 116, the developing device 10 (10A, 10B, 10C, 10D) which carries out toner development of the corresponding color on the electrostatic latent image formed on the photosensitive drum 116, and the like.

A sheet feed cassette 124, in which sheets P are accommodated, is provided at the lower portion of the printer 110. A pick-up roller 126, which feeds the sheet P out at a predetermined timing, is provided in a vicinity of the sheet feed cassette 124.

The sheet P, which is fed-out from the sheet feed cassette 124 by the pick-up roller 126, is fed-into a sheet conveying path 132 via conveying rollers 128 and registration rollers 130, and is conveyed to a conveying device 144 which conveys the sheet P to the process cartridges 120.

The process cartridges 120 are disposed in the order of the aforementioned colors of Y, M, C, K from the upstream side of the sheet conveying path 132. An exposure device 134, which illuminates scan light to the process cartridges 120, is disposed at the left side of the process cartridges 120 in FIG. 1.

At the exposure device 134, an unillustrated semiconductor laser (device), a polygon mirror 138, focusing lenses 140, and mirrors 142 are disposed within a housing 136. The light from the semiconductor laser is deflected and scanned by the polygon mirror 138, and is illuminated onto the photosensitive drums 116 via the focusing lens 140 and the mirrors 142. In this way, electrostatic latent images corresponding to image information are formed on the photosensitive drums 116.

An image data processing unit 166 is provided at a position adjacent to the exposure device 134. Further, a control circuit 168, which controls the operations of the exposure device 134, the process cartridges 120, a fixing device 156, and the like, is provided beneath the exposure device 134.

The aforementioned conveying device 144 is disposed at the right side in FIG. 1 of the printer 110 (at a position opposing the photosensitive drums 116). The conveying device 144 is structured by a pair of stretching rollers 146, 148 which are provided along a side wall 110A of the printer 110, and a conveying belt 150 which is trained around the stretching rollers 146, 148. The stretching roller 148 is rotated by an unillustrated motor, and the conveying belt 150 moves.

An attracting roller 154 is disposed in a vicinity of the stretching roller 146. Due to voltage being applied to the attracting roller 154, the sheet P is electrostatically attracted to the conveying belt 150.

Transfer rollers 152 are disposed respectively at positions opposing the photosensitive drums 116 of the respective colors, at the reverse surface of the conveying belt 150. The toner images on the photosensitive drums 116 are transferred by the transfer rollers 152 onto the sheet P, which is conveyed by the conveying belt 150, and are fixed at the fixing device 156. Then, the sheet P on which the toner image is fixed is discharged-out to a discharge tray 160 by discharging rollers 158.

The developing device 10 relating to the first exemplary embodiment of the present invention will be described next.

The developing device 10 in the first exemplary embodiment of the present invention uses a two-component developing method.

Figure 2:
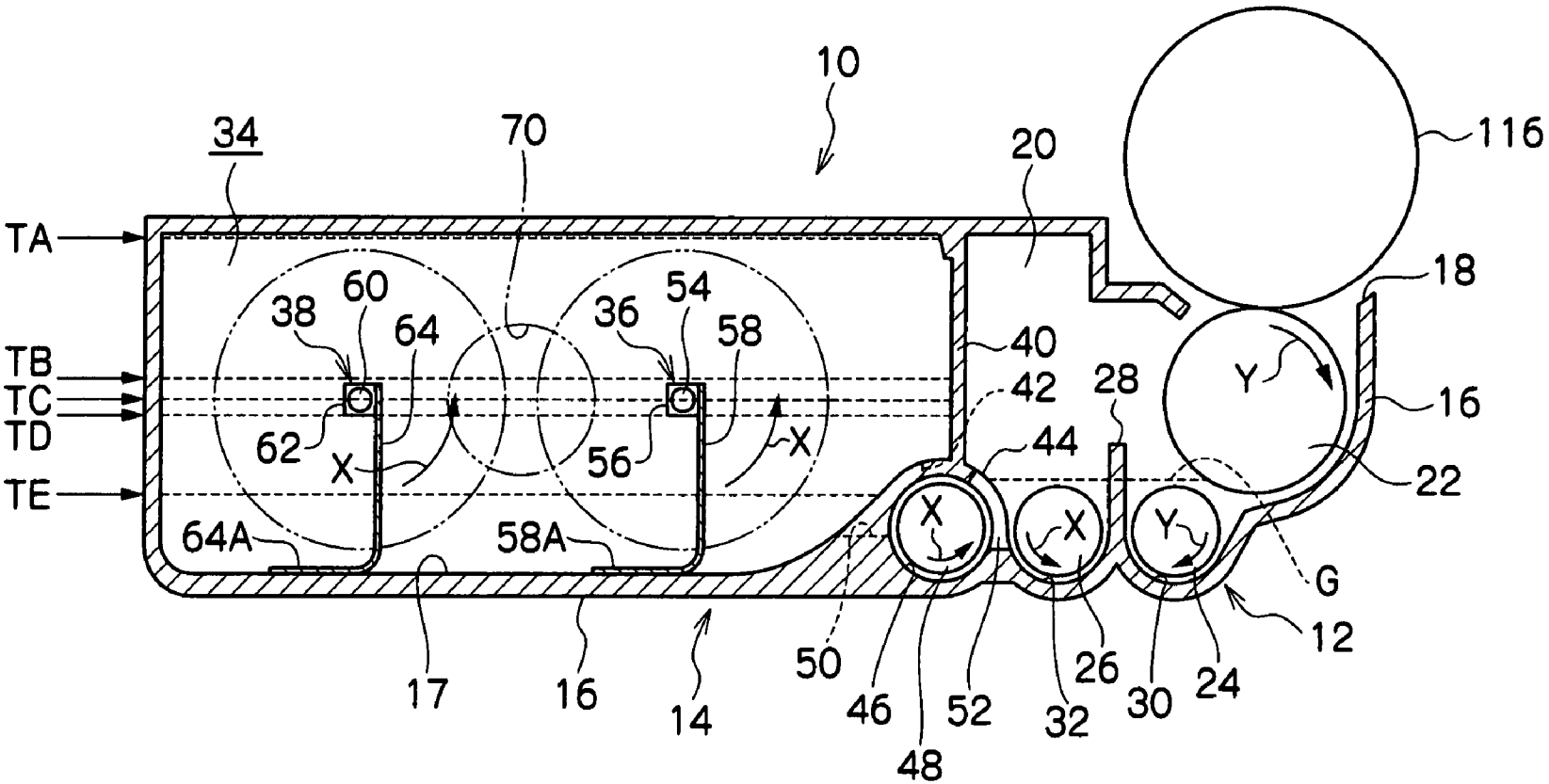
FIG. 2 is a cross-sectional view of a developing device relating to a first exemplary embodiment and a second exemplary embodiment of the present invention.

As shown in FIG. 2, the developing device 10 is structured such that a developing unit 12 and a toner replenishing unit 14 are integral in the lateral direction. The developing unit 12 is disposed at a position opposing the photosensitive drum 116, and makes the electrostatic latent image on the photosensitive drum 116 into a visible image by a developer G which is formed from a toner and a carrier. The toner replenishing unit 14 supplies toner T to the developing unit 12.

The developing unit 12 includes a housing 16 which is a case made of resin. The housing 16 is provided at the lower side of the photosensitive drum 116. An opening 18, which opens toward the photosensitive drum 116, is formed in the housing 16. The shape of the housing is a flat, substantially rectangular shape at which the length of the floor wall is longer than the length (the height in FIG. 2) of the side wall.

A developer accommodating chamber 20 is formed within the housing 16. The developer G, which is formed from toner and carrier, is accommodated in the developer accommodating chamber 20.

A developing roller 22 is disposed within the housing 16 such that a portion thereof is exposed from the opening 18 of the housing 16. The developing roller 22 is pivotally-supported at the peripheral wall of the housing 16 so as to be rotatable. An unillustrated gear is fixed to an end portion of the developing roller 22. Rotational force from an unillustrated motor is transferred to the gear, and the developing roller 22 can rotate in the direction of arrow Y via the gear.

The developing roller 22 attracts, by magnetic force, the carrier included in the developer G, forms a magnetic brush of the developer G on its surface, and conveys the toner adsorbed to the carrier to a developing region opposing the photosensitive body. Then, the electrostatic latent image formed on the photosensitive body becomes a visible image by the magnetic brush of the developer G which is formed from the carrier and the toner and is formed on the surface of the developing roller 22.

A first stirring/conveying auger 24 and a second stirring/conveying auger 26 are disposed along the axial direction of the developing roller 22, beneath the developing roller 22. The first stirring/conveying auger 24 and the second stirring/conveying auger 26 each have an unillustrated rotating shaft, and are pivotally-supported at the peripheral wall of the housing 16 so as to be rotatable.

A first partitioning wall 28 is formed between the first stirring/conveying auger 24 and the second stirring/conveying auger 26. The interior of the developer accommodating chamber 20 is divided in two by the first partitioning wall 28 into a first stirring path 30 at which the first stirring/conveying auger 24 is disposed and a second stirring path 32 at which the second stirring/conveying auger 26 is disposed.

Unillustrated communicating openings are formed at both longitudinal direction end portions of the first partitioning wall 28, and the first stirring path 30 and the second stirring path 32 communicate with one another by these communicating openings. In this way, the developer G within the developer accommodating chamber 20 is, by the rotation of the first stirring/conveying auger 24 and the second stirring/conveying auger 26, conveyed within the first conveying path 30 and the second conveying path 32 respectively while being stirred, and the developer G circulates between the first conveying path 30 and the second conveying path 32.

On the other hand, a toner accommodating chamber 34, in which the toner T is accommodated, is provided in the toner replenishing unit 14 which is adjacent to the developing unit 12. A first agitator 36 and a second agitator 38 are provided in the toner accommodating chamber 34 along the axial direction of the developing roller 22.

A second partitioning wall 40, a curved wall 42, and a third partitioning wall 44 are provided between the toner accommodating chamber 34 and the developer accommodating chamber 20.

Due to the curved wall 42 extending from the lower portion of the second partitioning wall 40 toward the toner accommodating chamber 34, and the third partitioning wall 44 extending from the lower portion of the second partitioning wall 40 toward the developer accommodating chamber 20, a tunnel-shaped dispensing chamber 46 is formed in the floor portion of the housing 16. A dispensing auger 48, which stirs and conveys toner along the longitudinal direction, is provided in the dispensing chamber 46.

A toner supply opening 50 is formed in a vicinity of one longitudinal direction end portion of the curved wall 42, at a corner portion where the floor wall and a side wall of the housing 16 are adjacent, so as to communicate the toner accommodating chamber 34 and the dispensing chamber 46. In this way, the toner T which is accommodated within the toner accommodating chamber 34 is conveyed in the axial direction within the toner accommodating chamber 34 while being stirred by the first agitator 36, and is fed-into the dispensing chamber 48 from the toner supply opening 50.

On the other hand, an opening 52 is formed in a vicinity of the other longitudinal direction end portion of the third partitioning wall 44, so as to communicate the dispensing chamber 46 and the developer accommodating chamber 20. In this way, the toner T within the dispensing chamber 46 is conveyed within the dispensing chamber 46 while being stirred by the dispensing auger 48, and is fed-into the developer accommodating chamber 20 from the opening 52.

The opening 52 is formed such that the lower end portion thereof is positioned lower than the position of the surface of the developer G accommodated in the developer accommodating chamber 20. In this way, at least a portion of the opening 52 is in a state of being buried by the developer G accommodated in the developer accommodating chamber 20. The toner T, which is fed-into the developer accommodating chamber 20 from the dispensing chamber 46, creeps-into the developer Q and is easy to mix-together with the developer G accommodated in the developer accommodating chamber 20.

The first agitator 36 includes a first rotating shaft 54, a first rotating member 56, and a first stirring/conveying film 58, and is pivotally-supported at the peripheral wall of the toner replenishing unit 14 so as to be rotatable. The position of the first agitator 36 is a predetermined position which is separated from the floor wall and the side walls of the housing 16.

The first stirring/conveying film 58, which is formed of a flexible resin film such as PET or the like, is fixed to the first rotating member 56 of the first agitator 36 by being affixed by adhesion along the axial direction of the first rotating member 56.

Before usage starts, the first stirring/conveying film 58 is set to a length such that it can slidingly-rub the toner supply opening 50 at the corner portion of the housing 16.

Here, a slope is formed at the curved wall 42 only at the upstream side in the sliding-rubbing direction of the first stirring/conveying film 58 with respect to the toner supply opening 50, and no slope is formed at the downstream side of the curved wall 42, such that the capacity within the housing 16 can be made to be large.

The second agitator 38 includes a second rotating shaft 60, a second rotating member 62, and a second stirring/conveying film 64, and is pivotally-supported at the peripheral wall of the toner replenishing unit 14 so as to be rotatable. The position of the second agitator 38 is a predetermined position which is separated from the floor wall and the side walls of the housing 16.

The second stirring/conveying film 64, which is formed of a flexible resin film such as PET or the like, is fixed to the second rotating member 62 of the second agitator 38 by being affixed by adhesion along the axial direction of the second rotating member 62. The length of the second stirring/conveying film 64 is set to be the same as the length of the first stirring/conveying film 58.

A toner filling opening 70 is provided in the peripheral wall of the housing 16 which the peripheral wall supports the first rotating shaft 54 and the second rotating shaft 60. The toner filling opening 70 is sealed by an unillustrated rubber cap at times other than when toner is being filled.

At times of filling toner, the developing device 10 is set upright in the vertical direction, the rubber cap is removed, and toner is poured-in from the toner filling opening 70.

Note that, after the toner is filled, the developing device 10 is used after being disposed in the horizontal direction.

In FIG. 2, the distance from a floor surface 17 of the toner accommodating chamber 34 to the top surface of the filled toner is shown by the dashed line as the toner fill height.

Here, the toner fill height means the height at the time when the usage of the developing device 10 starts, and is not necessarily the same as the height at the time when the toner is filled. This is because the toner is an aggregate of fine particles and has spaces therebetween, and therefore, the filling rate of the toner per unit capacity varies in accordance with the load from the exterior.

Note that, in the present exemplary embodiment, the toner height in a state in which the toner is filled-in densely is the toner fill height.

In the present exemplary embodiment, the relationship between the toner fill heights at the time of filling and at the time when usage starts is obtained as a calibration curve from data of the toner fill height after the toner T is stored for a predetermined time period after being filled into the developing device 10 in advance, and data of the toner fill height when the developing device 10 is shaken in the horizontal direction or the vertical direction immediately before usage begins. On the basis of this calibration curve, toner, which is of an amount such that the toner fill height at the time when usage starts can be obtained, is filled-in during the process of manufacturing the developing device 10.

As shown in FIG. 2, the fill height at which the toner accommodating chamber 34 is entirely filled with powder is TA, the fill height which is the height of the upper, horizontal tangent line among the tangent lines of circles circumscribing the cross-sections of the first rotating member 56 and the second rotating member 62 at the time when usage of the developing device 10 starts is TB, the fill height which is the axial center of the first rotating shaft 54 and the second rotating shaft 60 is TC, the fill height which is the height of the bottom surfaces of the cross-sections of the first rotating member 54 and the second rotating member 60 at the time when usage of the developing device 10 starts is TD, and the fill height in a state in which there is little remaining toner and the toner accommodating chamber 34 nears empty and the amount of toner supplied to the toner supply opening 50 is low is TE.

Here, in the first exemplary embodiment, the toner is filled-in in advance such that the toner fill height at the time when usage starts is greater than or equal to TD.

Operation of the first exemplary embodiment of the present invention will be described next.

As shown in FIG. 2, when an unillustrated motor is driven and the first agitator 36 and the second agitator 38 of the developing device 10 rotate in the direction of arrow X, the toner within the toner accommodating chamber 34 is stirred by the rotational forces and the elastic recovering forces of the first stirring/conveying film 58 and the second stirring/conveying film 64, and is conveyed to the toner supply opening 50.

Next, the toner which is supplied to the toner supply opening 50 is fed-into the dispensing chamber 46. The toner is conveyed to the opening 52 while the interior of the dispensing chamber 46 is stirred by the dispensing auger 48 in the dispensing chamber 46.

The toner which is conveyed to the opening 52 is supplied from the opening 52 to the developer accommodating chamber 20.

The toner supplied to the developer accommodating chamber 20 is mixed together with the developer Q and is supplied to the developing roller 22.

Figure 3A:
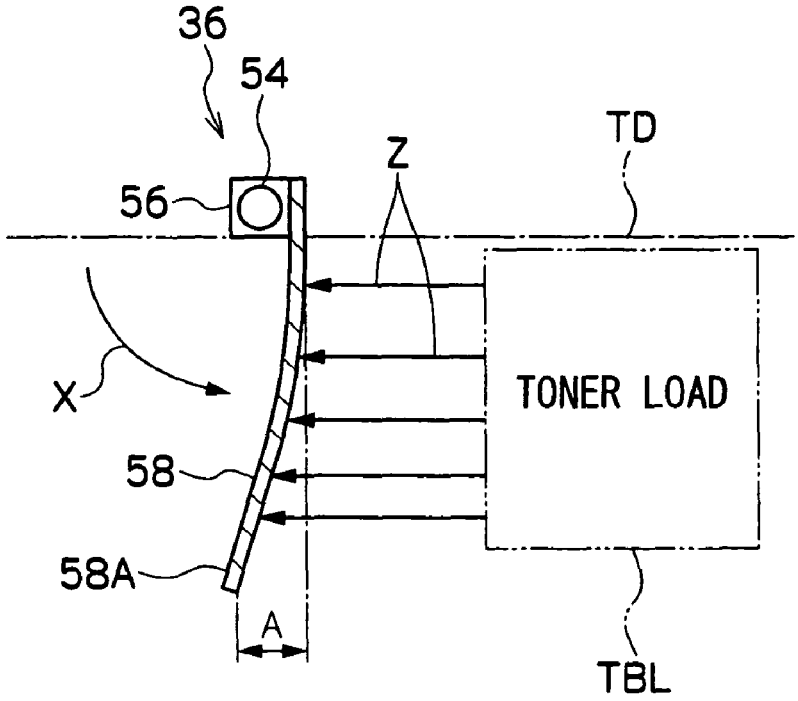
FIGS. 3A and 3B are cross-sectional schematic diagrams of an agitator relating to the first exemplary embodiment of the present invention.

Here, as shown in FIG. 3A, toner is filled-in to a height which is greater than or equal to the height of TD which is the bottom surface of the first rotating member 56. When the first agitator 36 rotates in the direction of arrow X, the load, in the direction of arrows Z, from a toner block TBL which is an aggregate of the toner is applied to the free end side region of the first stirring/conveying film 58, and the first stirring/conveying film 58 flexes toward the side opposite the X direction which is the rotating direction. The amount of flexure at this time is A.

Because the toner is filled-in to a height which is greater than or equal to the height of TD, when the first agitator 36 rotates one time, the first stirring/conveying film 58 receives load from the toner block TBL for at least ½ of the rotation (180°) around the first rotating shaft 54. In this way, a curl remains in the first stirring/conveying film 58.

Figure 3B:
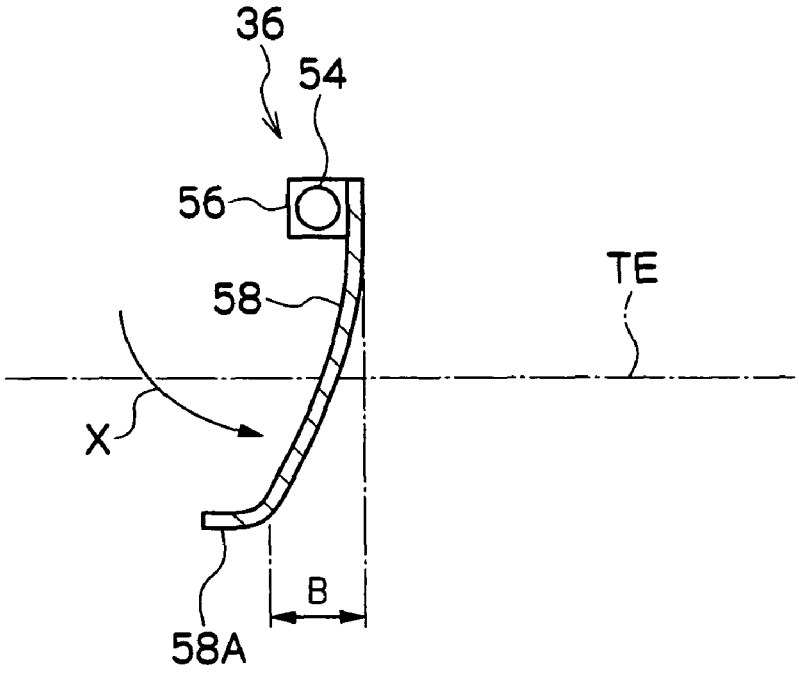

As shown in FIG. 3B, when the toner is consumed and the toner fill height becomes TE, the amount of flexure of the first stirring/conveying film 58 is B. The amount of flexure B is, in addition to the amount of flexure A as the curl-remaining caused by the toner block TBL at the time when usage starts, also the amount of flexure caused by the permanent set in fatigue of the first stirring/conveying film 58 itself is increased, and therefore, B>A.

In this way, toner load is applied to the first stirring/conveying film 58 from the start of usage. When a curl remains and the elastic recovering force weakens, the moving acceleration at the time when a distal end portion 58A slidingly-rubs the inner wall of the housing 16 (see FIG. 1) is decreased, and the noise arising at the time of contact is decreased.

Here, the noise generated at times when the toner fill height is from TA to TE is shown in Table 1.

Note that "start of usage" shows the state of the noise at the time when usage of the developing device 10 starts, and "before end of usage" shows the state of the noise at the time when the amount of toner remaining within the housing 16 of the developing device 10 has become slight.

TABLE 1

| toner fill height at start of usage | noise generated | |
|---|---|---|
| | start of usage | before end of usage |
| TA (25 mm) | ◎ | ◎ |
| TB (15 mm) | ◎ | ◎ |
| TC (12.5 mm) | Δ | ○ |
| TD (10 mm) | Δ | ○ |
| TE (5 mm) | X | X |

◎: no noise
○: hardly any noise
Δ: to the extent that it cannot be heard due to other operational noises
X: great noise As can be understood from Table 1, if the toner fill height is made to be greater than or equal to TD, the noise before the end of usage is reduced. The above effects are similar for the second agitator 38 as well.

Note that, in the structure in which the toner merely flows-in from the toner filling opening 70 and the structure in which the toner is filled-in while being pressed, the toner filling rate of the latter is better.

The compression ratio is an index showing the toner filling rate. The degree of compression is measured by determining the ratio of the bulk density in a loosely filled state, and the bulk density in a densely filled state after tapping thereof is carried out.

As described above, in the first exemplary embodiment of the present invention, toner of an amount such that the height thereof is greater than or equal to the bottom surfaces of the first rotating member 56 and the second rotating member 62 at the start of usage of the developing device 10, is filled into the housing 16 at the time of filling the toner. Therefore, from the time of the start of usage of the developing device 10, the flexible regions of the free end side regions of the first stirring/conveying film 58 and the second stirring/conveying film 64 receive load from the toner within the housing 16 at least for greater than or equal to one-half a rotation per one rotation of the rotating members.

In this way, until the toner within the housing 16 is used up, curl remains in the first stirring/conveying film 58 and the second stirring/conveying film 64. The acceleration of the free end side regions of the first stirring/conveying film 58 and the second stirring/conveying film 64, after the free end side regions have passed through the region in which the toner is filled, decreases, and the noise at the time when they contact the inner wall of the housing 16 can be made to be low.

The developing device 10 can suppress noise at the time of usage even in a developing device having the flat, substantially rectangular housing 16 which can accommodate a large amount of toner while suppressing the dead space at the printer 110 in which the developing device 10 is installed.

Namely, at the housing 16 which is flat and substantially rectangular, the first stirring/conveying film 58 and the second stirring/conveying film 64 flex greatly when at the flat region of the housing 16, and the flexure is released at the time when they pass beyond the flat region, and it is easy for noise, which arises due to them hitting, rubbing, or the like the inner wall of the housing 16, to be generated. However, before the start of usage of the developing device 10, toner of an amount which has a height which is greater than or equal to the height of the bottom surfaces of the first rotating member 56 and the second rotating member 62 is filled in the housing 16. In this way, at the initial stage of the start of usage, even if the first stirring/conveying film 58 and the second stirring/conveying film 64 which are greatly flexed are released, noise generated by hitting, rubbing or the like the inner wall of the housing 16 can be reduced due to the toner working as resistance, and toner can be sufficiently supplied to the toner supply opening 50 provided at the corner portion of the housing 16.

As usage progresses, a flex remains in the first stirring/conveying film 58 and the second stirring/conveying film 64 due to the working of the toner and the inner wall of the flat, substantially rectangular housing 16. Therefore, even when the first stirring/conveying film 58 and the second stirring/conveying film 64 which are flexed are released, the action of their hitting, rubbing or the like the inner wall of the housing 16 has been weakened, and noise can be reduced.

Moreover, at the initial stage of the start of usage when there is a large amount of toner, it may be a state in which the first stirring/conveying film 58 and the second stirring/conveying film 64 have less of a flex-remaining therefore great noise may be produced. However, at this stage, the toner is sufficiently conveyed to the powder supply opening 50 at the corner portion of the housing 16, and noise is suppressed due to the toner working as resistance.

When usage progresses and at the time when the amount of toner has decreased, the first stirring/conveying film 58 and the second stirring/conveying film 64 are pressed by the toner and the inner wall of the housing 16 such that the flex remains thereat, and are no longer in a state in which great noise is produced. At this time, the amount of toner has become small, however, because lengths of the first stirring/conveying film 58 and the second stirring/conveying film 64 are long, they can sufficiently convey the toner even while having this flex-remaining.

The lengths of the first stirring/conveying film 58 and the second stirring/conveying film 64 are sufficiently long, that is, are lengths such that they can slidingly-rub the corner portion of the flat, substantially rectangular housing 16. Therefore, even when usage progresses from the initial stage at the start of usage, both the ability to suppress noise and a good toner conveying performance can be achieved.

A slope is formed at the curved wall 42 only at the upstream side thereof in the sliding-rubbing direction of the first stirring/conveying film 58, and there is no slope at the downstream side, such that the capacity within the housing 16 can be made to be large. Therefore, the capacity of the housing interior can be made to be large, while both a reduction in noise and a good toner conveying performance are achieved.

A second exemplary embodiment of a powder supplying device, a method of filling a powder into a powder supplying device, and a method of reusing a powder supplying device of the present invention will be described next on the basis of the figures.

Note that parts which are basically the same as those of the previously-described first exemplary embodiment are denoted by the same reference numerals as in the first exemplary embodiment, and description thereof is omitted.

Figure 4A:
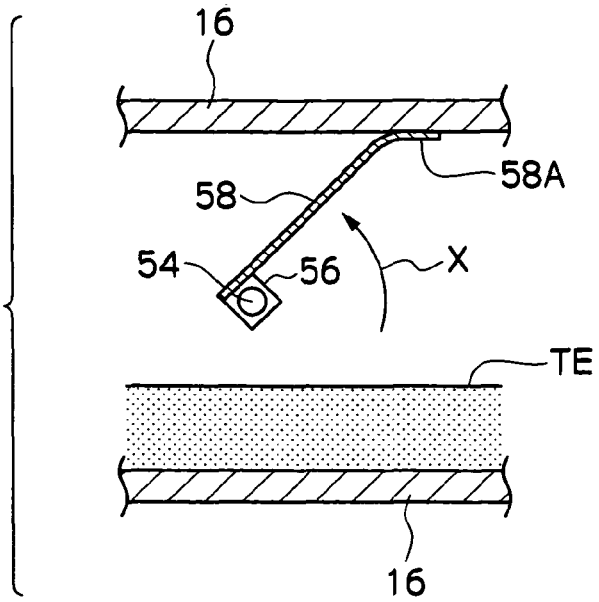
FIGS. 4A through 4C are cross-sectional views of an agitator relating to the second exemplary embodiment of the present invention.

FIG. 4A shows a state of contact between the distal end portion 58A of the first stirring/conveying film 58 and an inner wall of the housing 16 at the time when the toner fill height is TE.

As is clear from FIG. 4A, because the first stirring/conveying film 58 is not receiving load from the toner, the first stirring/conveying film 58 is substantially flat, and the acceleration of the distal end portion 58A due to the rotation of the first rotating member 56 is the greatest. Therefore, the impact force at the time of contact between the distal end portion 58A and the inner wall of the housing 16 is also a maximum, and the noise generated due to the contact between the both also is great (refer to Table 1).

Figure 4B:
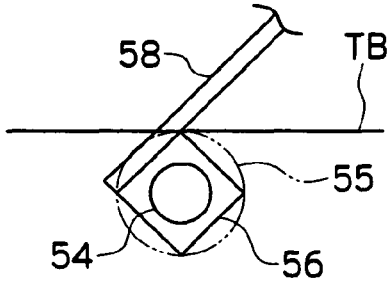

Here, the toner fill height TB will be described by using FIG. 4B.

The line of the toner fill height TB is the same as the upper, horizontal tangent line among the tangent lines of a circumscribing circle 55 of the first rotating member 56.

The toner fill height being greater than or equal to TB means that, at the time when the first rotating member 56 rotates, toner always exists in a vicinity of the fixed end (the position nearest to the first rotating member 56) in the free end side region (flexible region) of the first stirring/conveying film 58. When the first rotating member 56 rotates, the load of the toner is always applied to a vicinity of the fixed end in the free end side region of the first stirring/conveying film 58.

Operation of the second exemplary embodiment of the present invention will be described next.

Figure 4C:
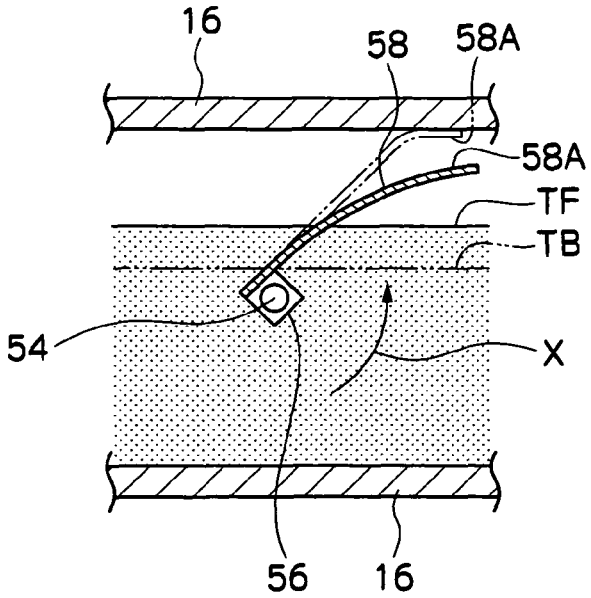

As shown in FIG. 4C, if, for example, the toner fill height is greater than or equal to TB and toner is filled to the height of TF, the distal end portion 58A of the first stirring/conveying film 58 is in the state shown by the solid line due to the toner which exists in the region from the toner fill height TB to TF.

If the toner fill height is lower than TB, the distal end portion 58A of the first stirring/conveying film 58 is in the state shown by the two-dot chain line in FIG. 4C due to not receiving load from the toner.

Here, at the time of the start of usage of the developing device 10 (see FIG. 2), if the toner fill height is lower than TB, there is the state shown in FIG. 4A, and great noise is generated. However, if the toner fill height is higher than TB, the first stirring/conveying film 58 always receives load from the toner and flexes. Therefore, the impact in the contact with the inner wall of the housing 16 is mitigated, and the noise which is generated is low (refer to Table 1).

The same holds with regard to the second stirring/conveying film 64 as well.

The above-described toner filling method is effective not only in cases in which the developing device 10 is newly manufactured, but also at times of reclamation such as recycling or the like.

A method in which the first stirring/conveying film 58 and the second stirring/conveying film 64 are replaced with new ones and toner is refilled is an example of a method of reclaiming the developing device 10. If the toner fill height is made to be greater than or equal to TB at the time of refilling the toner, even if a stirring/conveying film which is new and whose elastic force is strong is used, load is always applied to the stirring/conveying film by the toner, and the stirring/conveying film flexes. Therefore, the noise at the time when usage starts can be made to be low.

As described above, at the time of the start of usage of the developing device 10, toner, which is of an amount such that it is a height greater than or equal to the height of the upper, horizontal tangent line among the tangent lines of the circles circumscribing the cross-sections of the respective rotating members, is filled into the housing 16. In this way, toner always exists in the vicinity of the fixed end of the flexible region of each conveying member at the time when usage of the developing device 10 starts.

In this way, even when the free end side of each conveying member passes through the region in which the toner is filled and heads upward, each conveying member receives load from the toner.

Accordingly, the elastic recovering force of each conveying member is suppressed, the acceleration in the vicinity of the fixed end in the flexible region decreases, and the noise at the time of contacting the inner wall of the housing 16 can be made to be low.

Further, when the developing device 10 is reclaimed (reused), toner exists in the rotating directions of the respective conveying members. Therefore, for example, even if the conveying members are replaced by new, sheet-shaped members which have not yet been used and which have strong elasticity, the conveying members can be flexed by the load of the toner. Further, when the rotating members rotate, the elastic recovering forces of the free end side regions of the conveying members can be suppressed. Therefore, the conveying members do not hit the wall with force.

For these reasons, the generation of noise can be suppressed from the start of reuse.

Note that the present invention is not limited to the above-described exemplary embodiments.

The first rotating member 56 and the second rotating member 62 may be shaped as polygonal columns or cylindrical columns rather than quadrilateral columns.

Plural notches may be provided in the first stirring/conveying film 58 and the second stirring/conveying film 64 in the direction heading toward the toner supply opening 50.

In a case in which the positions of the centers of rotation of plural rotating members are different, the rotating member whose position of the center of rotation is the lowest may be used as the reference.

What is claimed is:

1. A method of filling a powder into a powder supplying device comprising:

a housing that accommodates the powder;

a rotating member disposed rotatably within the housing;

a sheet-shaped conveying member fixed to the rotating member, whose free end side region, which is different from a fixed portion, slidingly-contacts and moves along an inner wall of the housing by rotation of the rotating member to convey the powder and is configured to contact an upper face of the inner wall of the housing after passing through the powder; and a powder supply opening provided at the housing at a downstream side in a direction of conveying the powder, wherein, as seen from an axial direction of the rotating member, the housing has a substantially flat-rectangle shape and a length of a planar floor wall is longer than a length of a side wall of the housing, the housing has a curved all extending from a lower portion of the side wall to planar floor wall, the powder supply opening is provided on the curved wall and a slope is formed on the powder supply opening provided at the curved wall of the housing, the rotating member is disposed at a predetermined position apart from the planar floor wall and the side wall, the method comprising filling, into the housing, the powder in an amount such that, at a time when usage of the powder supplying device starts, a height of the powder is greater than or equal to a height of a bottom surface of the rotating member.

2. The method according to claim 1, wherein powder is filled in an amount such that the height of the powder is greater than or equal to a height which maintains the powder in contact with the bottom surface of the rotating member as the rotating member rotates through a full rotation.

3. A method of reusing a powder supplying device, the method comprising returning a state of the powder supplying device after use thereof to an unused state, by using a method of filling the powder into the powder supplying device comprising:

a housing that accommodates the powder;

a rotating member disposed rotatably within the housing;

a sheet-shaped conveying member fixed to the rotating member, whose free end side region, which is different from a fixed portion, slidingly-contacts and moves along an inner wall of the housing by rotation of the rotating member to convey the powder and is configured to contact an upper face of the inner wall of the housing after passing through the powder; and a powder supply opening provided at the housing at a downstream side in a direction of conveying the powder, wherein, as seen from an axial direction of the rotating member, the housing has a substantially flat-rectangle shape and a length of a planar floor wall is longer than a length of a side wall of the housing, the housing has a curved wall extending from a lower portion of the side wall to a planar floor wall, the powder supply opening is provided on the curved wall and a slope is formed on the powder supply opening provided at the curved wall of the housing, the rotating member is disposed at a predetermined position apart from the planar floor wall and the side wall, the method of filling comprising filling, into the housing, the powder in an amount such that, at a time when usage of the powder supplying device starts, a height of the powder is greater than or equal to a height of a bottom surface of the rotating member.

4. The method according to claim 3, wherein powder is filled in an amount such that the height of the powder is greater than or equal to a height which maintains the powder in contact with the bottom surface of the rotating member as the rotating member rotates through a full rotation.

5. A powder supplying device comprising:

a housing that accommodates a powder;

a rotating member disposed rotatably within the housing;

a sheet-shaped conveying member fixed to the rotating member, whose free end side region, which is different from a fixed portion, slidingly-contacts and moves along an inner wall of the housing by rotation of the rotating member to convey the powder; and a powder supply opening provided at the housing at a downstream side in a direction of conveying the powder, wherein, as seen from an axial direction of the rotating member, the housing has a substantially flat-rectangle shape at which a length of a plane floor wall of the housing is longer than a length of a side wall of the housing, the housing is provided with the powder supply opening at a corner portion at which the floor wall and the side wall are adjacent, a curved wall extending from a lower portion of the side wall to the floor wall is formed at the corner portion, the powder supply opening being formed at the curved wall, a slope is formed only at an upstream side, in a sliding-rubbing direction of the sheet-shaped conveying member, of the powder supply opening provided at the curved wall of the housing, the free end side of the sheet-shaped conveying member is configured to contact an upper face of the inner wall of the housing after the sheet-shaped conveying member passes through a powder filled region of the housing, the rotating member and the sheet-shaped conveying member are different members, the housing is provided with the rotating member at a predetermined position which is apart from the floor wall and the side wall, and the powder is filled into the housing in an amount such that, before usage of the powder supplying device starts, a height of the powder is greater than or equal to a height of a bottom surface of the rotating member.

6. The powder supplying device of claim 5, wherein the sheet-shaped conveying member is set to a length such that the conveying member can slidingly-rub the powder supply opening provided at the corner portion of the housing, before usage of the powder supplying device starts.

7. The powder supplying device of claim 6, wherein the powder is filled into the housing in an amount such that, before usage of the powder supplying device starts, a height of the powder is greater than or equal to a height of an upper, horizontal tangent line among tangent lines of a circumscribing circle of a cross-section of the rotating member.

8. The powder supplying device of claim 5, wherein the powder is filled into the housing in an amount such that, before usage of the powder supplying device starts, a height of the powder is greater than or equal to a height of an upper, horizontal tangent line among tangent lines of a circumscribing circle of a cross-section of the rotating member.

9. The powder supplying device of claim 5, wherein:

in the housing, a plurality of the rotating members and a plurality of the sheet-shaped conveying members are provided, and the powder is filled into the housing in an amount such that, before usage of the powder supplying device starts, a height of the powder is greater than or equal to a height of a bottom surface of the rotating member whose heightwise position from the bottom surface is the lowest among the plurality of the rotating members.

10. The powder supplying device of claim 9, wherein the powder is filled into the housing in an amount such that, before usage of the powder supplying device starts, a height of the powder is greater than or equal to a height of an upper, horizontal tangent line among tangent lines of a circumscribing circle of a cross-section of the rotating member whose heightwise position from the bottom surface is the lowest.

11. The powder supplying device according to claim 5, wherein the height of the powder is greater than or equal to a height which maintains the powder in contact with the bottom surface of the rotating member as the rotating member rotates through a full rotation.

12. A method of filling a powder into a powder supplying device comprising:

a housing that accommodates the powder;

a rotating member disposed rotatably within the housing;

a sheet-shaped conveying member fixed to the rotating member, whose free end side region, which is different from a fixed portion, slidingly-contacts and moves along an inner wall of the housing by rotation of the rotating member to convey the powder; and a powder supply opening provided at the housing at a downstream side in a direction of conveying the powder, wherein powder is filled in an amount such that the height of the powder is greater than or equal to a height which maintains the powder in contact with the bottom surface of the rotating member as the rotating member rotates through a full rotation, the method comprising filling, into the housing, the powder in an amount such that, at a time when usage of the powder supplying device starts, a height of the powder is greater than or equal to a height of a bottom surface of the rotating member.

13. A method of reusing a powder supplying device, the method comprising returning a state of the powder supplying device after use thereof to an unused state, by using a method of filling the powder into the powder supplying device comprising:

a housing that accommodates the powder;

a rotating member disposed rotatably within the housing;

a sheet-shaped conveying member fixed to the rotating member, whose free end side region, which is different from a fixed portion, slidingly-contacts and moves along an inner wall of the housing by rotation of the rotating member to convey the powder; and a powder supply opening provided at the housing at a downstream side in a direction of conveying the powder, wherein powder is filled in an amount such that the height of the powder is greater than or equal to a height which maintains the powder in contact with the bottom surface of the rotating member as the rotating member rotates through a full rotation, the method of filling comprising filling, into the housing, the powder in an amount such that, at a time when usage of the powder supplying device starts, a height of the powder is greater than or equal to a height of a bottom surface of the rotating member.

14. A powder supplying device comprising:

a housing that accommodates a powder;

a rotating member disposed rotatably within the housing;

a sheet-shaped conveying member fixed to the rotating member, whose free end side region, which is different from a fixed portion, slidingly-contacts and moves along an inner wall of the housing by rotation of the rotating member to convey the powder; and a powder supply opening provided at the housing at a downstream side in a direction of conveying the powder, wherein, as seen from an axial direction of the rotating member, the housing is shaped as a flat, substantial rectangle at which a length of a floor wall of the housing is longer than a length of a side wall of the housing, the housing is provided with the powder supply opening at a corner portion at which the floor wall and the side wall are adjacent, the housing is provided with the rotating member at a predetermined position which is apart from the floor wall and the side wall, and the powder is filled into the housing in an amount such that, before usage of the powder supplying device starts, a height of the powder is greater than or equal to a height of a bottom surface of the rotating member, and wherein the height of the powder is greater than or equal to a height which maintains the powder in contact with the bottom surface of the rotating member as the rotating member rotates through a full rotation.

15. The method of filling a powder into a powder supplying device of claim 1, wherein the powder is filled into the housing in an amount such that, at the time when usage of the powder supplying device starts, the height of the powder is greater than or equal to a height of an upper, horizontal tangent line among tangent lines of a circumscribing circle of a cross- section of the rotating member.

16. The method of reusing a powder supplying device of claim 3, wherein the powder is filled into the housing in an amount such that, at the time when usage of the powder supplying device starts, the height of the powder is greater than or equal to a height of an upper, horizontal tangent line among tangent lines of a circumscribing circle of a cross-section of the rotating member.

* * * * *